US009139942B2

(12) United States Patent
Azeyanagi

(10) Patent No.: US 9,139,942 B2
(45) Date of Patent: Sep. 22, 2015

(54) NEEDLE PLATE OF SEWING MACHINE

(71) Applicant: JANOME SEWING MACHINE CO., LTD., Hachioji-shi, Tokyo (JP)

(72) Inventor: Kazuyoshi Azeyanagi, Hachioji (JP)

(73) Assignee: JANOME SEWING MACHINE CO., LTD., Hachioji-shi (JP)

( * ) Notice: Subject to any disclaimer, the term of this patent is extended or adjusted under 35 U.S.C. 154(b) by 0 days.

(21) Appl. No.: 14/307,669

(22) Filed: Jun. 18, 2014

(65) Prior Publication Data

US 2014/0373766 A1 Dec. 25, 2014

(30) Foreign Application Priority Data

Jun. 24, 2013 (JP) ..... 2013-131595

(51) Int. Cl.
*D05B 73/12* (2006.01)
*D05B 77/00* (2006.01)
*D05B 83/00* (2006.01)

(52) U.S. Cl.
CPC ..... *D05B 73/12* (2013.01); *D05B 77/00* (2013.01); *D05B 83/00* (2013.01)

(58) Field of Classification Search
CPC ..... D05B 73/10; D05B 73/12; D05B 77/00; D05B 83/00
USPC ..... 112/260; 108/38, 50.01
See application file for complete search history.

(56) References Cited

U.S. PATENT DOCUMENTS

| | | | | | |
|---|---|---|---|---|---|
| 271,728 | A | * | 2/1883 | Miller | 112/260 |
| 312,196 | A | * | 2/1885 | Freeman | 112/136 |
| 907,485 | A | * | 12/1908 | Fellows | 112/136 |
| 2,751,869 | A | * | 6/1956 | Walcoff | 112/260 |
| 3,159,125 | A | * | 12/1964 | Vandewouwer | 112/260 |
| 3,545,393 | A | * | 12/1970 | Meier | 112/260 |
| 4,150,633 | A | * | 4/1979 | Adams | 112/260 |
| 4,407,210 | A | * | 10/1983 | Jung et al. | 112/167 |
| 4,441,444 | A | * | 4/1984 | Jung | 112/311 |

FOREIGN PATENT DOCUMENTS

JP 3069939 U 7/2000

* cited by examiner

*Primary Examiner* — Ismael Izaguirre
(74) *Attorney, Agent, or Firm* — Westerman, Hattori, Daniels & Adrian, LLP

(57) ABSTRACT

A needle plate of a sewing machine mounted on an upper surface of a bed of the sewing machine includes a support surface for supporting a fabric pressed by a presser foot, a needle opening through which a needle passes, and a feed dog slot through which a feed dog moves up and down and back and forth. The support surface has small projections and recesses.

20 Claims, 4 Drawing Sheets

NEEDLE PLATE OF SEWING MACHINE

BACKGROUND OF THE INVENTION

1. Field of the Invention

The present invention relates to a needle plate of a sewing machine mounted on an upper surface of a bed of a sewing machine, and, in particular, to a needle plate of a sewing machine that can smoothly feed a fabric that generates high friction, such as a non-slip fabric, a leather fabric, or a plastic fabric.

2. Description of the Related Art

A needle plate, which is mounted on an upper surface of a bed of a sewing machine, includes a support surface for supporting a fabric, a needle opening through which a needle passes, and a feed dog slot through which a feed dog moves up and down and back and forth. A presser foot presses the fabric against the support surface, and the feed dog, which moves up and down and back and forth through the feed dog slot, feeds the fabric. During sewing, an operator manipulates the fabric to assist feeding of the fabric.

Needle plates used to date have had a support surface that is smooth over its entire area so that an operator can smoothly manipulate a fabric during sewing. Moreover, a surface coating is formed on the smooth surface.

Typically, the surface coating is formed via electroless nickel phosphorus PTFE composite plating, which is performed by using nickel as a basis metal, co-depositing PTFE (polytetrafluoroethylene) particles, and heat-curing the co-deposited layer.

It is well known that such a support surface can reduce the friction between the support surface and a fabric that is being fed over the support surface, due to the presence of a self-lubricating coating formed via electroless nickel phosphorus PTFE composite plating (see, for example, Japanese Registered Utility Model No. 3069939).

The needle plate described in Japanese Registered Utility Model No. 3069939, which has a self-lubricating coating formed via electroless nickel phosphorus PTFE composite plating on its support surface, is effective for sewing an ordinary fabric. However, the needle plate has a problem in that fabric feeding and fabric manipulation are not improved when it is used for a fabric having high adherence to a smooth surface, such as a non-slip fabric, a leather fabric, or a plastic fabric, because such a fabric tends to adhere to the support surface and may fail to smoothly slide over the needle plate.

Moreover, a fabric can smoothly slide over the needle plate described in Japanese Registered Utility Model No. 3069939, because the needle plate has the self-lubricating coating. Accordingly, in a case where the needle plate is used for a smooth fabric or an elastic fabric, the fabric may be pulled by the needle and may slide over the support surface when the needle passes through the fabric. As a result, the fabric may be pulled by the needle into the needle opening of the needle plate.

If the needle moves upward from this state, a part of the fabric that has been pulled into the needle opening by the needle is raised together with the needle. Accordingly, an operation of forming an upper thread loop, which is performed by utilizing the friction between the upper thread and the fabric, might not be appropriately performed, and only a small upper thread loop may be formed. As a result, a loop taker may fail to hook the upper thread loop, and a problem of skipped stitches may occur.

SUMMARY OF THE INVENTION

An object of the present invention, which addresses the above problems, is to provide a needle plate of a sewing machine that can smoothly feed a fabric and that facilitates manipulation of a fabric.

To achieve the object, the present invention provides a needle plate of a sewing machine mounted on an upper surface of a bed of the sewing machine, the needle plate including a support surface for supporting a fabric pressed by a presser foot, a needle opening through which a needle passes, and a feed dog slot through which a feed dog moves up and down and back and forth. The support surface has small projections and recesses.

In an embodiment of the needle plate according to the present invention, the small projections and recesses are regularly arranged projections and recesses.

In a specific embodiment of the needle plate according to the present invention, the regularly arranged projections and recesses are evenly arranged discontinuous protrusions, or the regularly arranged projections and recesses are evenly arranged linear protrusions each extending continuously in a fabric feeding direction.

In another embodiment of the needle plate according to the present invention, the support surface has a rough surface portion instead of the small projections and recesses only in a region surrounding the needle opening. In a specific embodiment, the region surrounding the needle opening includes a region corresponding to the entire area of a lower surface of the presser foot that contacts the fabric.

In another embodiment of the needle plate according to the present invention, a surface of the small projections and recesses has a surface treatment layer made of a self-lubricating coating. In a specific embodiment, the self-lubricating coating may be formed via electroless nickel phosphorus PTFE composite plating, application of PTFE, or application of polyamide resin.

In the needle plate of a sewing machine according the present invention, the support surface has the small projections and recesses. Therefore, as compared with a needle plate having a support surface that is smooth over its entire area, the area of contact can be reduced because only the upper surfaces of the projections of the small projections and recesses contact the fabric. Accordingly, even a fabric having high adherence to a smooth surface, such as a non-slip fabric, a leather fabric, or a plastic fabric, can be prevented from sticking to the support surface.

With the embodiment in which a rough surface portion is formed instead of the small projections and recesses only in a region of the support surface surrounding the needle opening, even a smooth fabric or an elastic fabric is prevented from being pulled into the needle opening when the needle passes through the fabric. Therefore, the upper thread loop can be appropriately formed when the needle moves upward and occurrence of skipped stitches can be prevented.

In the case where the surface of the small projections and recesses has the surface treatment layer made of the self-lubricating coating, which is formed via electroless nickel phosphorus PTFE composite plating, application of PTFE, or application of polyamide resin, even a fabric having high adherence to a smooth surface, such as a non-slip fabric, can smoothly slide over the needle plate, and fabric feeding and fabric manipulation can be more appropriately performed.

DESCRIPTION OF THE PREFERRED EMBODIMENTS

Next, a needle plate of a sewing machine according to an embodiment of the present invention will be described with reference to the drawings.

Figure 1:
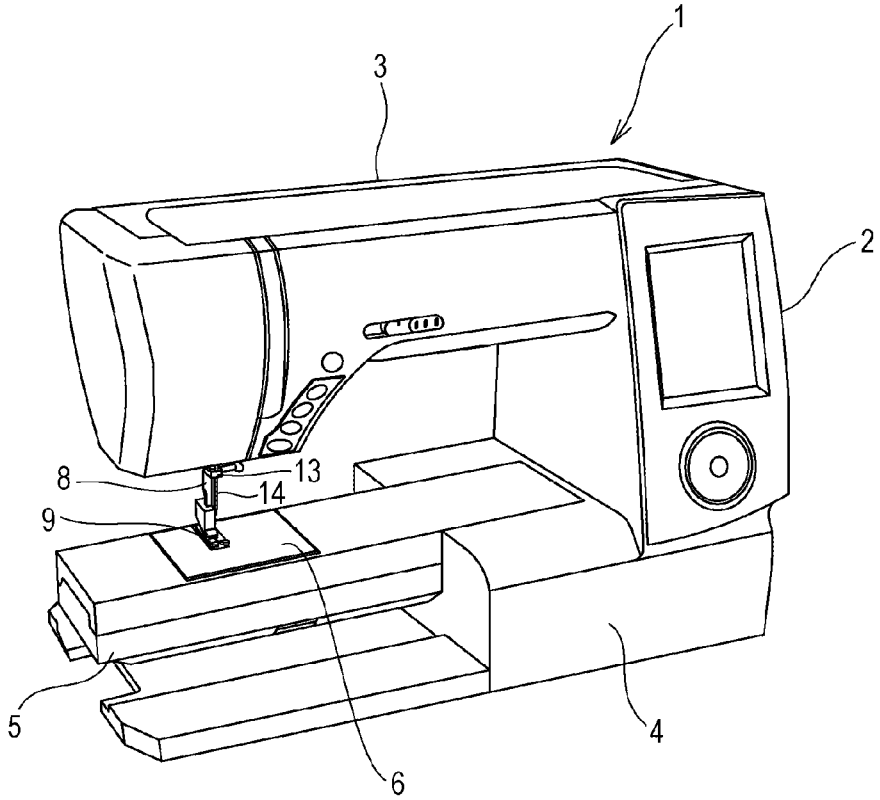
FIG. 1 is a perspective view of a sewing machine including a needle plate according to the present invention.

Referring to FIG. 1, a sewing machine includes an upper frame 1, which includes a column 2 and an arm 3 extending leftward from the column 2.

The sewing machine further includes a bed 4; a free arm 5, which is a substantially rectangular pipe extending from the bed 4; and a needle plate 6 mounted on an upper surface of the free arm 5.

Figure 2:
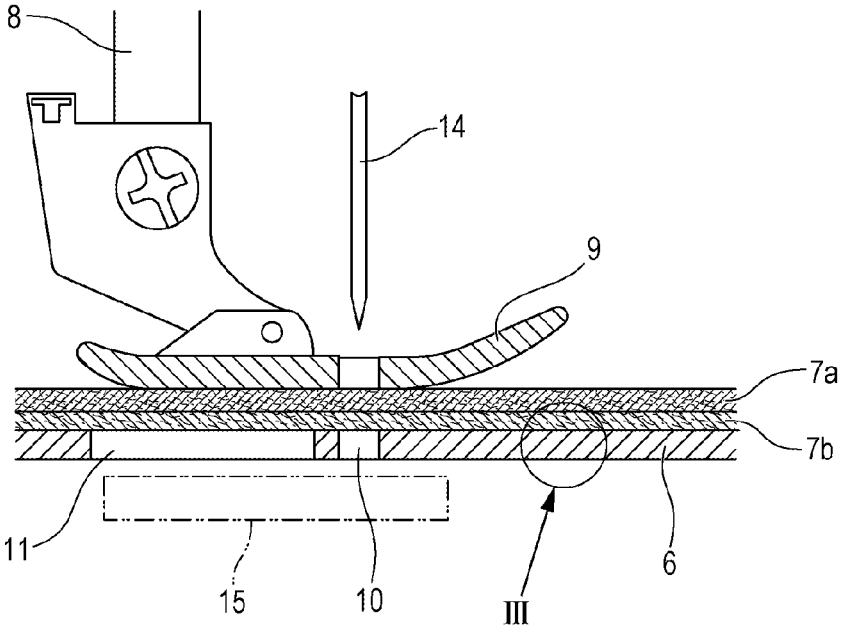
FIG. 2 is a horizontal sectional view of a sewing portion of the sewing machine according to the present invention.

As illustrated in FIGS. 1 and 2, two pieces of fabric 7*a* and 7*b* to be sewn together are supported by a support surface 6*b* and pressed from above with a predetermined pressure by a presser foot 9 that is attached to a presser bar 8 extending downward from the arm 3.

Figure 6:
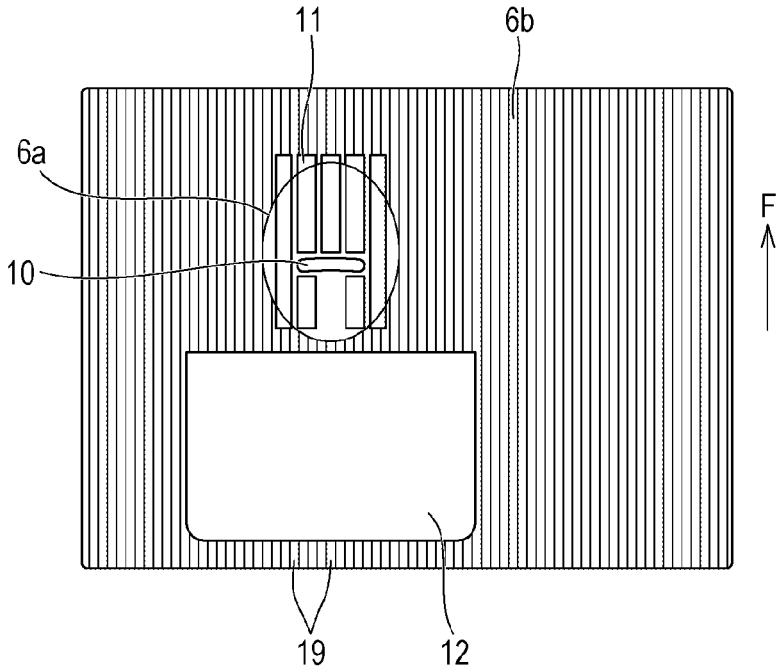
FIG. 6 is a top view of a needle plate according to a third embodiment of the present invention, in which a needle-opening-surrounding region is abrasive-blasted.

As illustrated in FIG. 6, the needle plate 6 has a needle opening 10 that is horizontally elongated and used for a zigzag stitch, a plurality of feed dog slots 11 that are vertically elongated, and an opening 12 that is used to replace a lower-thread bobbin therethrough.

An upper shaft driving mechanism (not shown) is disposed in the arm 3 of the upper frame 1. The upper shaft driving mechanism moves a needle bar 13 to which a needle 14 is fixed, and thereby the needle 14 passes through the pieces of fabric 7*a* and 7*b* and through the needle opening 10 of the needle plate 6. A lower shaft driving mechanism (not shown), which is disposed in the free arm 5, rotates a loop taker, and thereby the loop taker hooks an upper thread loop, which is formed when the needle 14 is moved upward, to form a stitch.

At the same time, a fabric feed mechanism (not shown), which is disposed in the free arm 5, drives a feed dog 15. The feed dog 15 moves up and down and back and forth through the feed dog slots 11 of the needle plate 6 to feed the pieces of fabric 7*a* and 7*b* in a predetermined direction.

First Embodiment

Figure 4A:
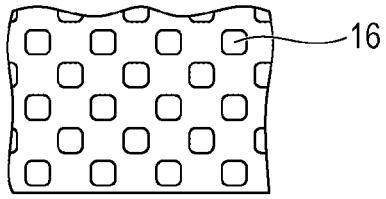
FIG. 4A is an enlarged top view illustrating an arrangement pattern of projections that are regularly arranged on a support surface according to the first embodiment of the present invention.
Figure 4B:
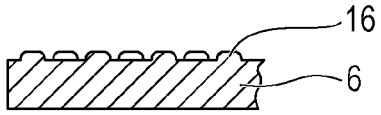
FIG. 4B is an enlarged cross-sectional view illustrating the arrangement pattern.

In a first embodiment, a plurality of square-shaped protrusions 16 are regularly arranged on the support surface 6*b* of the needle plate 6. The protrusions 16, each having a side length of 1.5 mm and a height of 50 μm (0.05 mm), are arranged at a distance of 2.5 mm from each other in the horizontal and vertical directions in an arrangement pattern shown in FIG. 4A. Edges of each of the protrusions 16 are smoothly curved.

Figure 3:
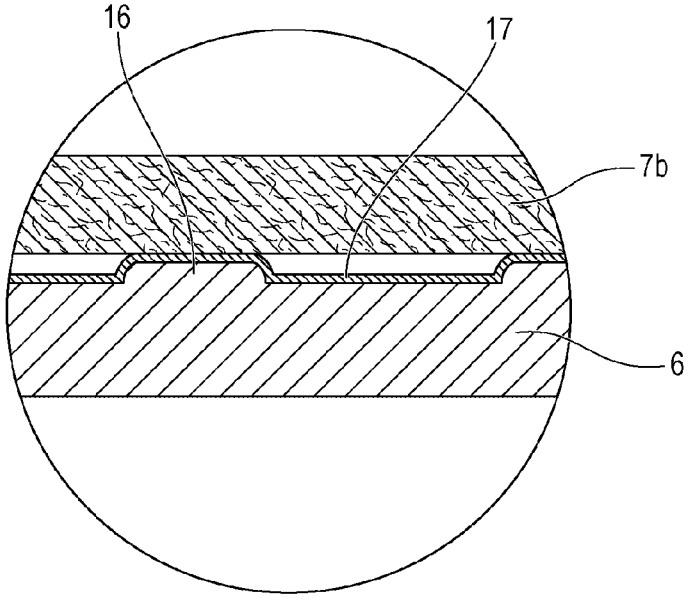
FIG. 3 is an enlarged view of the needle plate according to a first embodiment of the present invention, illustrating a region III of FIG. 2.

As illustrated in FIG. 3, the entirety of the support surface 6*b* is covered with a coating 17 having a thickness of 10 μm. The coating 17 is formed by performing electroless nickel phosphorus PTFE composite plating with a PTFE mass percentage of 25%.

Next, how the present embodiment is used and the operational effect of the present embodiment will be described.

When a sewing machine, having the needle plate 6 according to the present embodiment mounted on the upper surface of the free arm 5, is used to sew pieces of fabric that generates high friction, such as a non-slip fabric, a leather fabric, or a plastic fabric, the following advantage can be obtained. Because the protrusions 16 are regularly arranged on the support surface 6*b*, the lower surface of the piece of fabric 7*b* contacts only the upper surfaces of the protrusions 16, the area of contact can be reduced. As a result, even a fabric having high adherence to a smooth surface can be prevented from sticking to the support surface 6*b*.

Moreover, because the protrusions 16 formed on the support surface 6*b* are regularly arranged at an equal distance from each other in the horizontal and vertical directions, the pieces of fabric 7*a* and 7*b* can be smoothly fed in any directions.

Furthermore, the coating 17, which is formed on the entirety of the support surface 6*b* having the protrusions 16 formed thereon by performing electroless nickel phosphorus PTFE composite plating, is self-lubricating. Therefore, even a non-slip fabric or the like having high adhesion to a smooth surface can more smoothly slide over the support surface 6*b*. As a result, fabric feeding and fabric manipulation can be appropriately performed.

As described above, with the present embodiment, a fabric having high adherence to a smooth surface, such as a non-slip fabric, a leather fabric, or a plastic fabric, is prevented from sticking to the support surface 6*b*. As a result, fabric feeding and fabric manipulation can be appropriately performed.

In the present embodiment, the needle plate 6 is mounted on the free arm 5 of the bed 4. The present invention can be used not only for a sewing machine having the free arm 5 but also for sewing machines having beds of various types.

In the present embodiment, each protrusion 16 has a square shape in plan view and has smoothly formed edges. However, each protrusion 16 may have any shape in plan view, such as a rectangular shape, a circular shape, or an elliptical shape.

In the case where the shape of each protrusion 16 in plan view is a square, the length of each side is preferably about 1 to 2 mm. If the length of each side is less than 1 mm, the area of contact is too small, and the frictional resistance tends to increase. On the other hand, if the length of each side is greater than 2 mm, the area of contact is too large, and the frictional resistance tends to increase also in this case.

Preferably, the height of each protrusion 16 is about 40 to 70 μm. If the height is less than 40 μm, the lower surface of the piece of fabric 7*b* may contact recesses between the protrusions 16 and the frictional resistance tends to increase. On the other hand, if the height of each protrusion 16 is greater than 70 μm, the reduction in friction peaks out, while the processing cost is increased.

Preferably, the distance between adjacent protrusions 16 in the horizontal and vertical directions is about 1.5 to 3.5 mm, although the distance depends on the length of each side of the square.

In the present embodiment, the coating 17 is formed on the entirety of the support surface 6*b*, on which the protrusions 16 have been formed, by surface-treating the support surface 6*b* via electroless nickel phosphorus PTFE composite plating. However, the coating 17 is not necessary for the present invention. The method of surface treatment is not limited to electroless nickel phosphorus PTFE composite plating, which is used in the present embodiment. Various known methods for surface treatment, such as application of PTFE and application of polyamide resin, can be used.

Second Embodiment

Figure 5:
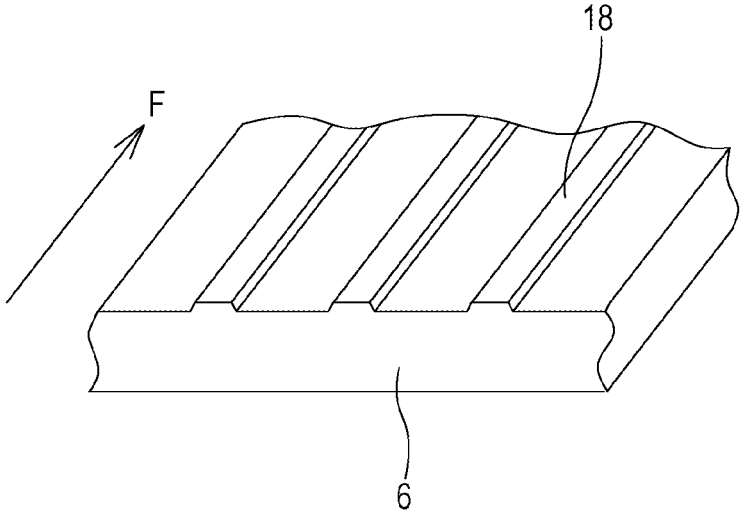
FIG. 5 is an enlarged perspective view illustrating an arrangement pattern of linear protrusions that are regularly arranged on a support surface according to a second embodiment of the present invention.

As illustrated in FIG. 5, in a second embodiment, linear protrusions 18 are formed on the support surface 6*b* so as to extend in a fabric feeding direction F. The linear protrusions 18, each having a width of 1 mm and a height of 60 μm, are regularly arranged at a distance of 2 mm from each other. Each linear protrusion 18 has a trapezoidal cross-sectional shape with smoothly curved edges.

The entirety of the support surface 6*b*, on which the linear protrusions 18 are arranged, is covered with a coating having a thickness of 20 μm, which is formed by application of PTFE.

Next, how the present embodiment is used and the operational effect of the present embodiment will be described.

In the present embodiment, the projections and recesses include the linear protrusions 18, which extend in the fabric feeding direction F and which are regularly arranged at an equal distance from each other. Therefore, the lower surface of the piece of fabric 7*b* contacts only the upper surfaces of the linear protrusions 18, and the area of contact can be reduced. As a result, even a fabric having high adhesion to a smooth surface can be prevented from sticking to the support surface 6*b*. Moreover, because the linear protrusions 18, each extending continuously in the fabric feeding direction F, are regularly arranged, the friction in the fabric feeding direction F is particularly low, and therefore the fabric can be fed linearly and meandering of a seam can be prevented.

In the present embodiment, the width of each linear protrusion 18 is 1 mm. Preferably, the width of each linear protrusion 18 is about 0.8 to 2 mm. In the present embodiment, the height of each linear protrusion 18 is 60 μm. Preferably, the height of each linear protrusion 18 is about 40 to 70 μm. In the present embodiment, the distance between adjacent linear protrusions 18 is 2 mm. Preferably, the distance is about 1 to 3 mm, although it depends on the width of each linear protrusion 18.

As in the first embodiment, the surface treatment of the support surface 6*b* is not necessary. In a case where surface treatment is necessary, various known methods for surface treatment can be used.

Third Embodiment

As illustrated in FIG. 6, in a third embodiment, linear protrusions 19 are formed on the support surface 6*b* so as to extend in a fabric feeding direction F. The linear protrusions 19, each having a width of 1.5 mm and a height of 60 μm, are regularly arranged at a distance of 1.5 mm from each other. As in the second embodiment, each linear protrusion 19 has a trapezoidal cross-sectional shape with smoothly curved edges.

In the present embodiment, the linear protrusions 19 are not formed only in a needle-opening-surrounding region 6*a* of the support surface 6*b*, and the needle-opening-surrounding region 6*a* is left flat. The needle-opening-surrounding region 6*a* is abrasive-blasted so as to form a rough surface portion that has a friction coefficient greater than that of other regions of the support surface 6*b*.

In other words, in the present embodiment, the support surface 6*b* has the rough surface portion instead of the regularly arranged projections and recesses only in the needle-opening-surrounding region 6*a*.

Figure 7:
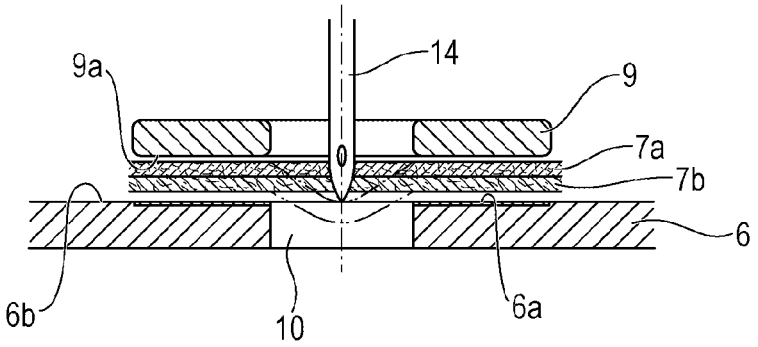
FIG. 7 is a schematic sectional view showing how a piece of fabric is pulled into a needle opening of a needle plate.

As illustrated in FIG. 7, preferably, the needle-opening-surrounding region 6*a* includes a region that corresponds to the entire area of a lower surface 9*a* of the presser foot 9 that contacts the upper surface of the piece of fabric 7*a*.

Next, how the present embodiment is used and the operational effect of the present embodiment will be described.

In FIG. 7, members of the sewing machine and pieces of fabrics are illustrated so as to be vertically separated from each other for convenience of illustration. In reality, however, at the time at which the needle 14 passes through the pieces of fabric 7*a* and 7*b*, the upper surface of the piece of fabric 7*a* and the lower surface of the piece of fabric 7*b* are respectively in contact with the lower surface 9*a* of the presser foot 9 and the support surface 6*b*.

On the other hand, at the time at which the feed dog 15 (see FIG. 2) moves up through the feed dog slots 11 (see FIG. 6) of the needle plate 6 and pushes the pieces of fabric 7*a* and 7*b* from below to perform fabric feeding, the lower surface of the piece of fabric 7*b* does not contact the rough surface portion of the needle-opening-surrounding region 6*a*.

According to the present embodiment, the needle-opening-surrounding region 6*a* of the support surface 6*b* is the rough surface portion. Therefore, even if the lower surface 9*a* of the presser foot 9 is a smooth surface over which a fabric can easily slide, at the time at which the needle 14 passes through the pieces of fabric 7*a* and 7*b*, a pressing force of the presser foot 9 is applied through the pieces of fabric 7*a* and 7*b* to the needle-opening-surrounding region 6*a* having a large friction coefficient. As a result, the piece of fabric 7*b* can be firmly pressed against the needle plate 6.

With an exiting needle plate having a smooth support surface, parts of the pieces of fabric 7*a* and 7*b* around the needle opening 10 are easily pulled into the needle opening 10 against the friction of the support surface 6*b* as illustrated in FIG. 7. Therefore, with the existing needle plate, a large upper thread loop cannot be formed when the needle 14 moves upward, and skipped stitches may occur. In contrast, with the present embodiment, as described above, the needle-opening-surrounding region 6*a* of the support surface 6*b* is the rough surface portion, and the fabric can be reliably pressed against the needle plate 6. As a result, the pieces of fabric 7*a* and 7*b* are prevented from being pulled into the needle opening 10, and a smooth sewing operation can be performed.

In the present embodiment, the support surface 6*b* has the rough surface portion only in the needle-opening-surrounding region 6*a*. Other regions of the support surface 6*b*, on which the regularly arranged linear protrusions 19 are formed, are very smooth. Therefore, at the time at which the feed dog 15 raises the pieces of fabric 7*a* and 7*b* to perform fabric feeding, due to the weights of the pieces of fabric 7*a* and 7*b* or due to a pressure applied by operator's fingers or the like, the lower surface the piece of fabric 7*b* contacts a region of the support surface 6*b* excluding the needle-opening-surrounding region 6*a*, which is very smooth. Accordingly, the lower surface of the piece of fabric 7*b* contacts only the upper surfaces of the linear protrusions 19, and therefore the area of contact can be reduced. As a result, even a fabric having high adhesion to a smooth surface can be prevented from sticking to the support surface 6*b*.

As in the first and second embodiments, the region of the support surface 6*b* on which the linear protrusions 19 are formed, excluding the needle-opening-surrounding region 6*a*, can be surface-treated by using various known methods, such as electroless nickel phosphorus PTFE composite plating, application of PTFE, and application of polyamide resin.

The needle plate of a sewing machine according the present invention has regularly arranged projections and recesses on the support surface. Therefore, as compared with a needle plate having a support surface that is smooth over its entire area, the area of contact can be reduced because only the upper surfaces of the projections contact the fabric. Accordingly, even a fabric having high adhesion to a smooth surface, such as a non-slip fabric, a leather fabric, or a plastic fabric, can be prevented from sticking to the support surface of the needle plate. As a result, the needle plate can be effectively used for various sewing machines.

What is claimed is:

1. A needle plate of a sewing machine mounted on an upper surface of a bed of the sewing machine, the needle plate comprising:

a support surface for supporting a fabric pressed by a presser foot;

a needle opening through which a needle passes; and a feed dog slot through which a feed dog moves up and down and back and forth, wherein the support surface has small projections and recesses, wherein the support surface has a rough surface portion instead of the small projections and recesses only in a region surrounding the needle opening.

2. The needle plate of a sewing machine according to claim 1, wherein the small projections and recesses are regularly arranged projections and recesses.

3. The needle plate of a sewing machine according to claim 2, wherein the regularly arranged projections and recesses include evenly arranged discontinuous protrusions.

4. The needle plate of a sewing machine according to claim 2, wherein the regularly arranged projections and recesses include evenly arranged linear protrusions each extending continuously in a fabric feeding direction.

5. The needle plate of a sewing machine according to claim 1, wherein the region surrounding the needle opening includes a region corresponding to the entire area of a lower surface of the presser foot that contacts the fabric.

6. The needle plate of a sewing machine according to claim 5, wherein the small projections and recesses are regularly arranged projections and recesses.

7. The needle plate of a sewing machine according to claim 6, wherein the regularly arranged projections and recesses include evenly arranged discontinuous protrusions.

8. The needle plate of a sewing machine according to claim 6, wherein the regularly arranged projections and recesses include evenly arranged linear protrusions each extending continuously in a fabric feeding direction.

9. A needle plate of a sewing machine mounted on an upper surface of a bed of the sewing machine, the needle plate comprising:

a support surface for supporting a fabric pressed by a presser foot;

a needle opening through which a needle passes; and a feed dog slot through which a feed dog moves up and down and back and forth, wherein the support surface has small projections and recesses, and wherein a surface of the small projections and recesses has a surface treatment layer made of a self-lubricating coating.

10. The needle plate of a sewing machine according to claim 9, wherein the small projections and recesses are regularly arranged projections and recesses.

11. The needle plate of a sewing machine according to claim 10, wherein the regularly arranged projections and recesses include evenly arranged discontinuous protrusions.

12. The needle plate of a sewing machine according to claim 10, wherein the regularly arranged projections and recesses include evenly arranged linear protrusions each extending continuously in a fabric feeding direction.

13. The needle plate of a sewing machine according to claim 9, wherein the support surface has a rough surface portion instead of the small projections and recesses only in a region surrounding the needle opening.

14. The needle plate of a sewing machine according to claim 13, wherein the small projections and recesses are regularly arranged projections and recesses.

15. The needle plate of a sewing machine according to claim 14, wherein the regularly arranged projections and recesses include evenly arranged discontinuous protrusions.

16. The needle plate of a sewing machine according to claim 14, wherein the regularly arranged projections and recesses include evenly arranged linear protrusions each extending continuously in a fabric feeding direction.

17. The needle plate of a sewing machine according to claim 13, wherein the region surrounding the needle opening includes a region corresponding to the entire area of a lower surface of the presser foot that contacts the fabric.

18. The needle plate of a sewing machine according to claim 17, wherein the small projections and recesses are regularly arranged projections and recesses.

19. The needle plate of a sewing machine according to claim 18, wherein the regularly arranged projections and recesses include evenly arranged discontinuous protrusions.

20. The needle plate of a sewing machine according to claim 18, wherein the regularly arranged projections and recesses include evenly arranged linear protrusions each extending continuously in a fabric feeding direction.

* * * * *